United States Patent [19]

Colli et al.

[11] Patent Number: 5,004,171

[45] Date of Patent: Apr. 2, 1991

[54] HIGH-PRODUCTIVITY BOBBIN WINDING METHOD AND DEVICES FOR ITS IMPLEMENTATION

[75] Inventors: Luigi Colli; Roberto Badiali; Nereo Marangone, all of Pordenone, Italy

[73] Assignee: Savio S.p.A., Pordenone, Italy

[21] Appl. No.: 522,173

[22] Filed: May 10, 1990

Related U.S. Application Data

[63] Continuation of Ser. No. 256,776, Oct. 11, 1988, abandoned.

[30] Foreign Application Priority Data

Nov. 13, 1987 [IT] Italy ..... 22624 A/87

[51] Int. Cl.[5] ..... B65H 54/22; B65H 63/00; B65H 67/08

[52] U.S. Cl. ..... 242/35.6 R; 242/36

[58] Field of Search ..... 242/35.6 R, 36, 35.5 R, 242/37 R, 39; 57/263

[56] References Cited

U.S. PATENT DOCUMENTS

| | | | |
|---|---|---|---|
| 4,033,107 | 7/1977 | Sasayama et al. | 57/263 |
| 4,078,737 | 3/1978 | Rehr | 242/39 |
| 4,163,358 | 7/1979 | Takeuchi et al. | 57/78 |
| 4,195,790 | 4/1980 | Reiners et al. | 242/35.6 R X |
| 4,228,642 | 10/1980 | Dakin et al. | 57/263 |
| 4,319,720 | 3/1982 | Ueda | 242/35.6 R X |
| 4,447,955 | 5/1984 | Stutz et al. | 242/39 X |

*Primary Examiner*—Stanley N. Gilreath

*Attorney, Agent, or Firm*—Hedman, Gibson, Costigan & Hoare

[57] ABSTRACT

A high-productivity bobbin winding method comprising a variable-duration intervention cycle for restoring yarn continuity. The cycle is divided into two parts, of which a first part is devoted to braking the bobbin and a second part is devoted to joining the yarn, between the commencement of the two parts there being interposed a delay which varies as a function of the time measured for the bobbin to come to rest during the preceding intervention cycle.

8 Claims, 6 Drawing Sheets

DEVELOPMENT OF THE BOBBIN STOPPAGE TIMES AS A FUNCTION OF THE WINDING SPEED 1
2
8
6
7
compressed air
3
5
9
4
FREN
SENS
CT
INV
MP
JOINING CONTROL
GIUNZ
MP
MP
100
JOINING ELEMENT

HIGH-PRODUCTIVITY BOBBIN WINDING METHOD AND DEVICES FOR ITS IMPLEMENTATION

This is a continuation of application Ser. No. 07/256776, filed Oct. 11, 1988, now abandoned.

This application is related to commonly assigned applications by Luigi Colli et al. for Improved Method of Restoring Yarn Continuity During Bobbin Winding And Devices For Its Implementation, Ser. No. 246,411, filed Sept. 19, 1988 now U.S. Pat. No. 4,958,779; Improved Bobbin Winding Method And Devices For Implementing Said Method, Ser. No. 258,372, filed Oct. 17, 1988 now U.S. Pat. No. 4,957,244; and Improved Bobbin Winding Method Comprising Variable Duration Interventions For Restoring Yarn Continuity And Devices For Its Implementation, Ser. No. 254,406, filed Oct. 6, 1988 now U.S. Pat. No. 4,964,581.

FIELD OF THE INVENTION

This invention relates to an improved bobbin winding method and devices for implementing said improved winding method. The improvement according to the invention enables the productivity of the winding operation to be increased and unproductive times to be eliminated or shortened.

BACKGROUND OF THE INVENTION

The winding operation consists substantially of transferring the yarn from a starting package and winding it on a rigid tube in order to form a structure wound in the form of cross turns and known as a bobbin, and during said transfer clearing the yarn of its imperfections and defects such as lumps, groups, naps, weak points, flocks etc. Said defects are eliminated by cutting out the defective portion and joining the ends.

This joint can be made either by a proper knot such as a fishermans knot or a weavers knot produced by a mechanical knotter, or by a pneumatic or friction joint in which the fibres of the cut ends are untwisted, intermixed and then retwisted to thus restore continuity to the cut yarn without introducing the hardly relevant irregularity represented by an actual knot.

The removal of yarn defects is commonly known as yarn clearing in that the defect is detected by a yarn clearer which is sensitive to yarn defects and can either itself break the continuity of the yarn or operate a separate cutting member.

Any discontinuity in the yarn causes the bobbin to undergo braking so that it stops, the yarn ends are picked up by mobile suckers and moved to the joining devices or knotters, the joined yarn is returned to its normal position and winding is recommenced, the bobbin and its drive roller being driven up from rest to the operating speed, which is generally of 600–1600 m/minute.

The winding speed is determined—within the limits of the possible winding machine performance—by the quality and count of the yarn to be wound.

The overall productivity of the operation is determined by the winding speed, the time taken by the overall intervention cycle and the actual number of interventions to be made.

It is therefore apparent that if a certain yarn is wound at a too high speed, the increased productivity resulting from the increase in speed is compromised by the down times deriving from the increase in the number of interventions required to restore the yarn continuity due to the greater number of yarn breakages. The bobbin is normally driven by a rotating roller—of right cylindrical or slightly tapering conical shape—which is kept in contact along a generator common to the two members. The technical problem to which the present invention relates derives from the fact that during the winding operation the rotating roller does not change its shape or size, whereas the bobbin continuously changes its size due to the increasing amount of yarn wound on it.

If the drive takes place under perfect friction, the peripheral speed of the drive roller is substantially equal to the linear winding speed of the yarn.

The yarn is guided so that it winds on the bobbin in a spiral arrangement using a yarn guide of various shapes or spiral grooves formed in the surface of the driving roller, in which the yarn engages.

By the action of such devices, the yarn is distributed over the bobbin surface by means of periodical travel along the bobbin generator.

The closer together the turns, the more dense is the bobbin and vice versa.

As the size of the bobbin increases, the linear yarn winding speed is kept substantially constant—this being a necessary condition for proper outcome of the operation—but the angular speed of the bobbin decreases linearly.

As the yarn travels along the contact generator in constant time, the number of turns wound for each travel stroke of the yarn guide reduces slightly but continuously for each wound layer.

As the bobbin forms it acquires an ever increasing inertia because of the increase in mass and its progressive distancing from the axis of rotation.

The first stage in the intervention cycle which commences with the cutting or tearing of the yarn by the passage of a defective portion through the yarn clearer is the braking of the bobbin so that its speed decreases to zero.

The brake must therefore absorb the kinetic energy possessed by the rotating bobbin, and its stoppage time is substantially proportional to said kinetic energy.

Generally, the bobbin is braked by a mechanical shoe brake—or equivalent type—operated by pressurised fluid such as compressed air, which is distributed by a solenoid valve which operates following the yarn discontinuity signal.

The drive roller is provided with its own braking devices, such as an inverter acting on its drive motor. To prevent damage to the bobbin it is desirable that the two braking actions take place independently, by withdrawing the bobbin and roller away from each other when the yarn discontinuity signal occurs at the commencement of the intervention cycle.

The operations subsequent to the stoppage can take place only when the bobbin is at rest.

In the known art the intervention cycle is effected as shown in the scheme of FIG. 1.

The duration of the intervention cycle is fixed and is divided into a fixed time available for stoppage and a fixed time for executing the other operations to be carried out during the intervention. After the stoppage time has passed, the bobbin must be completely at rest because otherwise the other intervention operations cannot be properly carried out, for instance it would be impossible to grip the end of the yarn on the bobbin side if this is still rotating.

The drive and control unit for the members which sequentially carry out the various operations of the intervention cycle is a mechanical system—such as a shaft provided with a series of cams so that when rotated, said cams sequentially encounter the drives for the various members, which consequently operate in sequence—or an equivalent electrical control system.

In this arrangement, the various intervention operations are performed sequentially by various members operated in accordance with a program of operation initiation times which are rigid and cannot be changed.

To be more precise, it should be noted that certain preliminary operations, such as moving the suckers into the correct position for seeking and picking up the yarn ends, these suckers being in their rest position at the commencement of the intervention cycle, can commence while the bobbin is still moving, but the actual operations of the intervention cycle subsequent to braking can only commence when the bobbin is properly at rest.

If the bobbins to be produced are small or if the operating speed is low, the time taken by those preliminary operations which can be carried out while the bobbin is still moving is longer than the bobbin stoppage time, and there are therefore no problems.

The fixed time allowed for bobbin stoppage must therefore correspond to the time required for absorbing the maximum kinetic energy which the bobbin can possess, and thus to its maximum possible winding speed, its maximum possible size and its maximum possible density. This time must then be increased by a certain safety margin to take account of any reduction in the efficiency of the braking system.

The current tendency in bobbin production is to increase winding speed and to maintain it when producing large-diameter bobbins. It is apparent that the criterion of assigning a fixed available time for bobbin stoppage based on the maximum kinetic energy which it can assume leads in most cases to a considerable time wastage because this fixed assigned time is necessary only when the bobbin has reached its maximum scheduled size and rotates at the maximum speed scheduled for this size.

This is very important because this time wastage—even if only of the order of a few seconds—is repeated during every intervention cycle for restoring yarn continuity, and this cycle can take place hundreds of times.

The deriving technical problem which the present invention solves is to assign a bobbin stoppage time within the intervention cycle which is no longer fixed but is variable, and corresponds substantially to the time which the braking device would require at any given moment to bring the bobbin to rest, this time depending on the kinetic energy of the bobbin at the moment of this operation.

SUMMARY OF THE INVENTION

The present invention consists therefore of an improved winding method and devices for its implementation. It consists of three essential component parts:

dividing the intervention cycle—and the control devices which implement it—into two separate parts, a first part for at least braking and stopping the bobbin and directly linked to the break in continuity of the wound yarn (and which hereinafter is called simply braking) and a second part for at least the further stages of the intervention cycle which have to be carried out when the bobbin is at rest (and which hereinafter is called simply joining), and interposing between the commencement of the stages involved in the two parts a variable delay which is to be determined at any given time, and is implemented by a timer device which controls the commencement of joining with a time displacement corresponding to said delay, which is equal to the time assigned for halting the bobbin;

measuring the state of progress in the formation of the bobbin and transmitting this to the unit for identifying the delay to be assigned;

identifying the delay to be assigned at any given time on the basis of the state of progress in the formation of the bobbin—and transmitting this to the timer device which implements this delay between the commencement of braking and the commencement of joining.

DESCRIPTION OF THE PREFERRED EMBODIMENT

Before describing in detail the three aforesaid essential parts of the invention, some introductory considerations are necessary. Mechanical bobbin braking systems exert a practically constant braking torque as the speed varies, and consequently the time required to halt the bobbin is essentially proportional to the bobbin kinetic energy.

The time required for stopping the bobbin is therefore unequivocally determined by its state of progress—once the braking torque of the braking device is known.

The bobbin stoppage time, and the kinetic energy which it possesses, depend therefore both on initially assigned parameters, namely:

yarn count initial tube size manner in which the yarn guide undergoes its travel strokes peripheral speed of the drive roller (which is substantially equal to the linear winding speed), which do not vary as the bobbin progresses, and also on the actual bobbin progress itself, which can be measured as the number of revolutions made by the drive roller from the commencement of bobbin formation, or the length of yarn already wound on the bobbin, or the useful time which has passed from said commencement. These three indications of the state of progress are all equivalent as they are related by strictly linear relationships.

Other indications of the state of progress of the bobbin under formation can be the number of revolutions undergone by the bobbin, its angular speed, its diameter etc.

Figure 1:
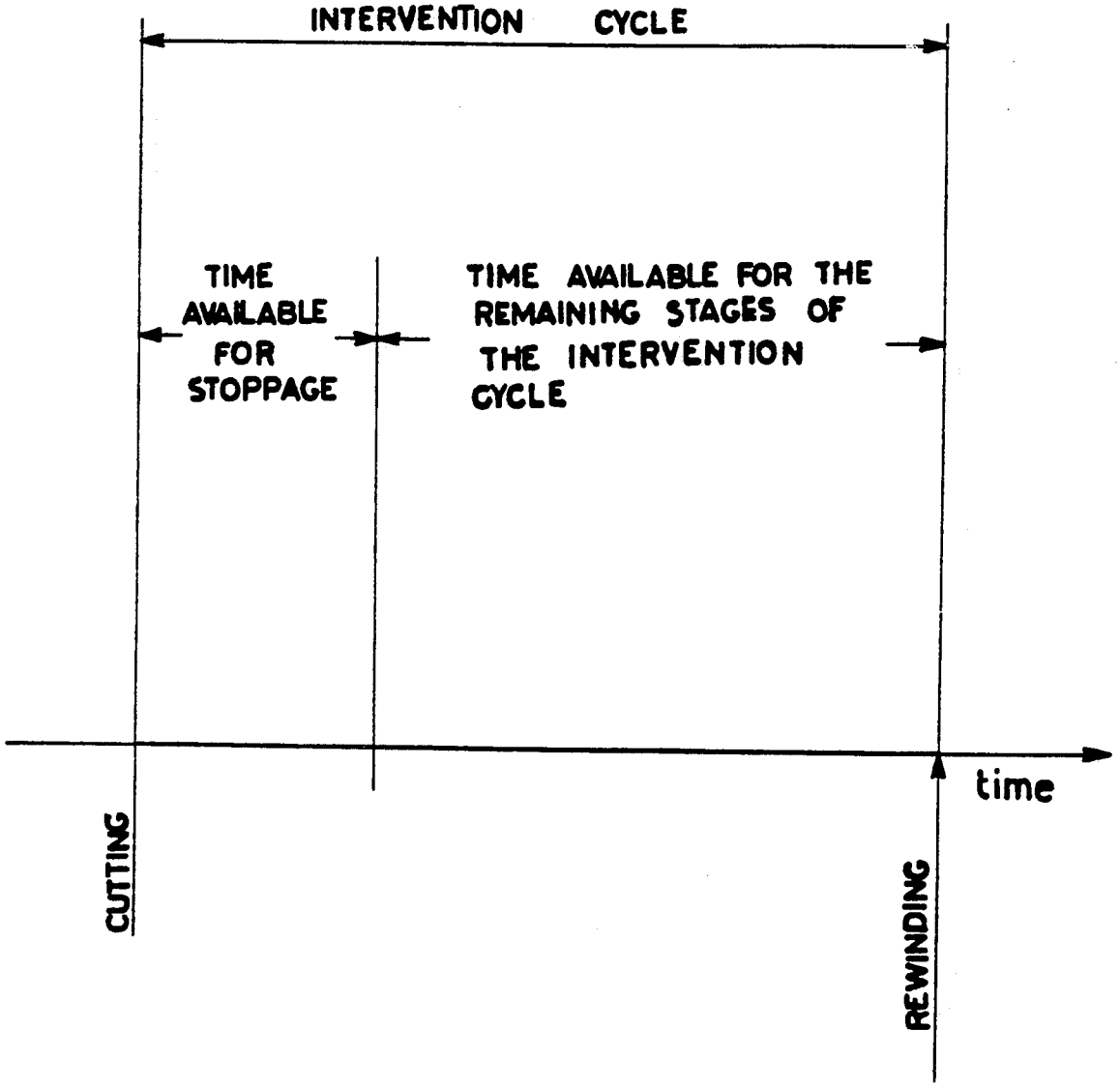
Fig.1 PRIOR ART
FIG. 1 is a graphical illustration of the prior art.
Figure 2:
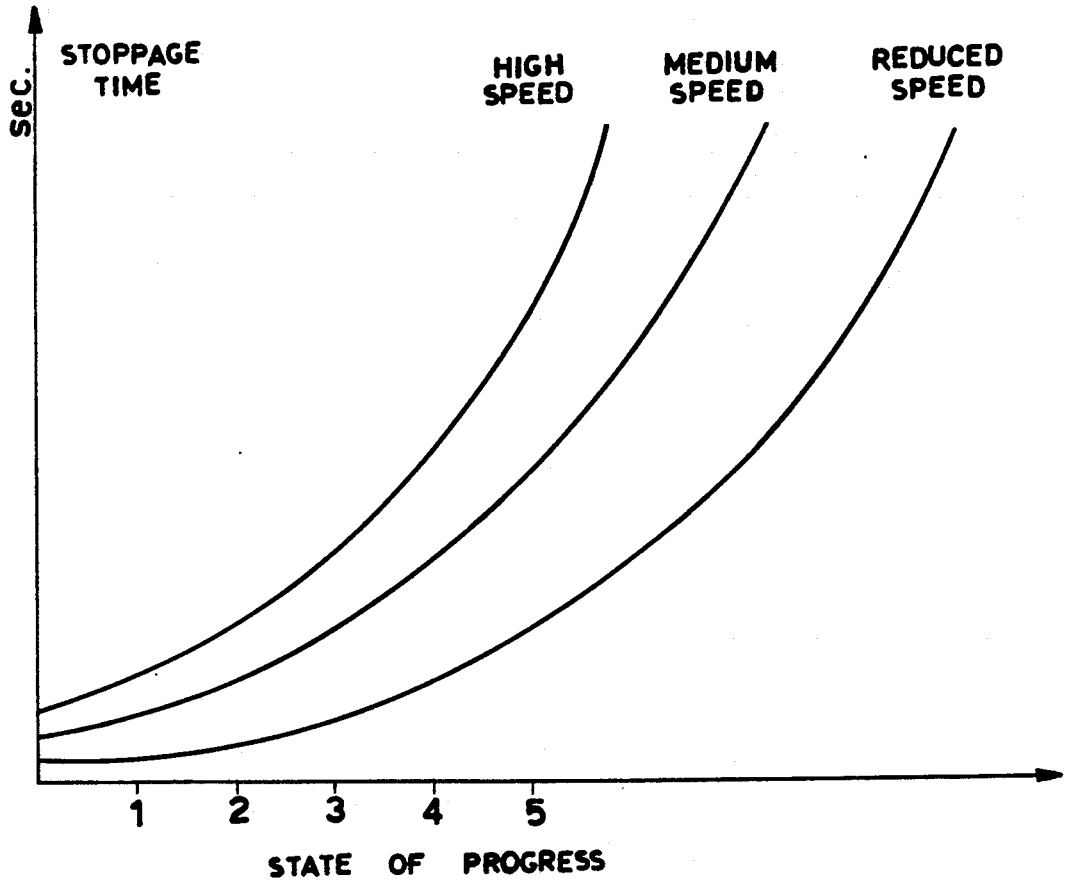
FIG. 2 is a graphical representation of bobbin stoppage times relative to the amount of yarn on the bobbin.

The variation in the times required to halt the bobbin as a function of its state of progress is shown in FIG. 2. Whichever of the aforesaid indications is used as the reference, the variation is always upwards with growth in the state of progress of the bobbin under formation.

The characteristics of the three essential parts of the present invention will now be described, commencing from the division of the intervention cycle and its control devices.

The first part of the intervention cycle, which commences on receipt of a signal indicating yarn discontinuity—either because it has been cut intentionally by the yarn clearer, or because it has broken naturally or because the feed package is empty—consists of the following main stages:

raising the bobbin away from the drive drum
braking the bobbin
braking the drive roller.

All these three operations are related to each other and are controlled either electrically, for example by means of a solenoid valve operating with compressed air, or mechanically by means of a rotary shaft provided with cams. The various operations concerned and the devices which implement them proceed without rigid time relationship with the second part of the intervention cycle. The second part of the intervention cycle can commence either simultaneously with the first—if no delay instruction has been transmitted by the delay identification unit—or with a delay in accordance with the instructions from said delay identification unit. The second part of the intervention cycle consists of the following main stages:

moving the suckers which seize the yarn ends on the bobbin side and package side;
sensing the presence of yarn;
if there is no yarn present on the package side, operating the package changing devices and, when the package has been changed, seizing the new yarn end on the package side;
disenabling the command which has implemented the first part of the cycle: the brakes are released, and the bobbin and roller are again brought into contact;
reversing the motion of the drive roller for a short time to allow the sucker which seizes the yarn end on the bobbin side to operate with a sufficient length of yarn to reach the knotter;
inserting the yarn ends into the knotter;
operating the knotter to join and then release the joined yarn (in the meantime the yarn seizing suckers can return to their rest position);
restarting the drive roller.

These stages of the second part can also be controlled mechanically, for instance by a rotary shaft provided with a series of cams which gradually operate the controls for the devices implementing the aforesaid steps, or by equivalent electrical or electronic devices.

The state of progress of the bobbin under formation is measured in the following manner.

The present invention is based on an empirical criterion which overcomes the complexity of the relationships between the winding parameters, which can vary with considerable frequency according to the type and count of the yarn being wound and according to the type of bobbin which any specific user may require. This criterion is based on the following considerations.

During the formation of a bobbin the breaks in yarn continuity are very frequent and can amount to some hundreds. The stoppages and restarts succeed each other with some frequency, and if there is no influence by outside factors each stoppage takes a progressively longer time. The effective time which the bobbin has taken to come to rest during the preceding intervention cycle will therefore be used as the empirical indication of its actual state of progress.

During each intervention cycle the time between the moment in which the command for braking the bobbin is given and the moment in which the bobbin-at-rest sensor indicates that it has actually stopped is measured.

Operationally, the bobbin-at-rest state can be likened to the attaining of an absolute or relative speed value which is below a predetermined minimum value.

By way of example, this sensor can consist of a relay coupled to a magnetic pick-up system with a polar wheel rigid with one of the rotary fixing centres of the bobbin carrier arm, or be in the form of equivalent sensors known to the art.

The measured value of the state of progress of the bobbin expressed as the time required for the bobbin to effectively come to rest during the preceding intervention cycle is fed to the unit for identifying the delay to be assigned.

The delay to be assigned is identified in the following manner. A progressively increasing series of times to be left available for halting the bobbin will be assumed.

For example, if the following time series is set:

2 seconds (not less than the time occupied by the preliminary operations which can be carried out while the bobbin is still moving),
3 seconds corresponding to a delay of 1 second,
4 seconds corresponding to a delay of 2 seconds,
5 seconds corresponding to a delay of 3 seconds,
6 seconds corresponding to a delay of 4 seconds, and so on.

This series of times, or delays, is set as a series of times to be assigned by the identification unit.

The criterion used in identifying the times or delays to be assigned for bobbin braking is that the time assigned should be greater than the time required for its effective stoppage.

This criterion consists of increasing in absolute or percentage terms the stoppage time measured during the preceding cycle and then assigning, as the time available for braking in the next intervention cycle, the minimum term of the aforesaid time series example plus the said increase.

If for example the chosen criterion consists of assigning a time available for braking which is not less than 120% of the effective stoppage time during the preceding intervention cycle, and if the series of values to be assigned is that stated heretofore by way of example, the values in seconds given in the following table are obtained:

| Effective measured stoppage time | Time available for braking | Delay ΔT |
|---|---|---|
| from 0 to 1.67 | 2 | — |
| from 1.67 to 2.5 | 3 | 1 |
| from 2.5 to 3.33 | 4 | 2 |
| from 3.33 to 4.17 | 5 | 3 |
| from 4.17 to 5 | 6 | 4 |

Consequently, the following series of pairs of values is obtained:

for $T_{lim1}=1.67$ seconds, delay $\Delta t_1=1$ second
for $T_{lim2}=2.5$ seconds, delay $\Delta t_2=2$ second
for $T_{lim3}=3.33$ seconds, delay $\Delta t_3=3$ second and so on.

In contrast, if the chosen criterion is to assign a time available for braking which is equal to the effective stoppage time during the preceding intervention cycle increased by 0.5 seconds, and the series of values to be assigned is that stated heretofore by way of example, the values in seconds given in the following table are obtained:

| Effective measured stoppage time | Time available for braking | Delay ΔT |
|---|---|---|
| from 0 to 1.5 | 2 | — |
| from 1.5 to 2.5 | 3 | 1 |
| from 2.5 to 3.5 | 4 | 2 |
| from 3.5 to 4.5 | 5 | 3 |
| from 4.5 to 5.5 | 6 | 4 |

there will be the following series of pairs of values:

for $T_{lim1}=1.5$ seconds, delay $\Delta t_1=1$ second for $T_{lim2}=2.5$ seconds, delay $\Delta t_2=2$ seconds for $T_{lim3}=3.5$ seconds, delay $\Delta t_3=3$ seconds and so on.

Figure 3:
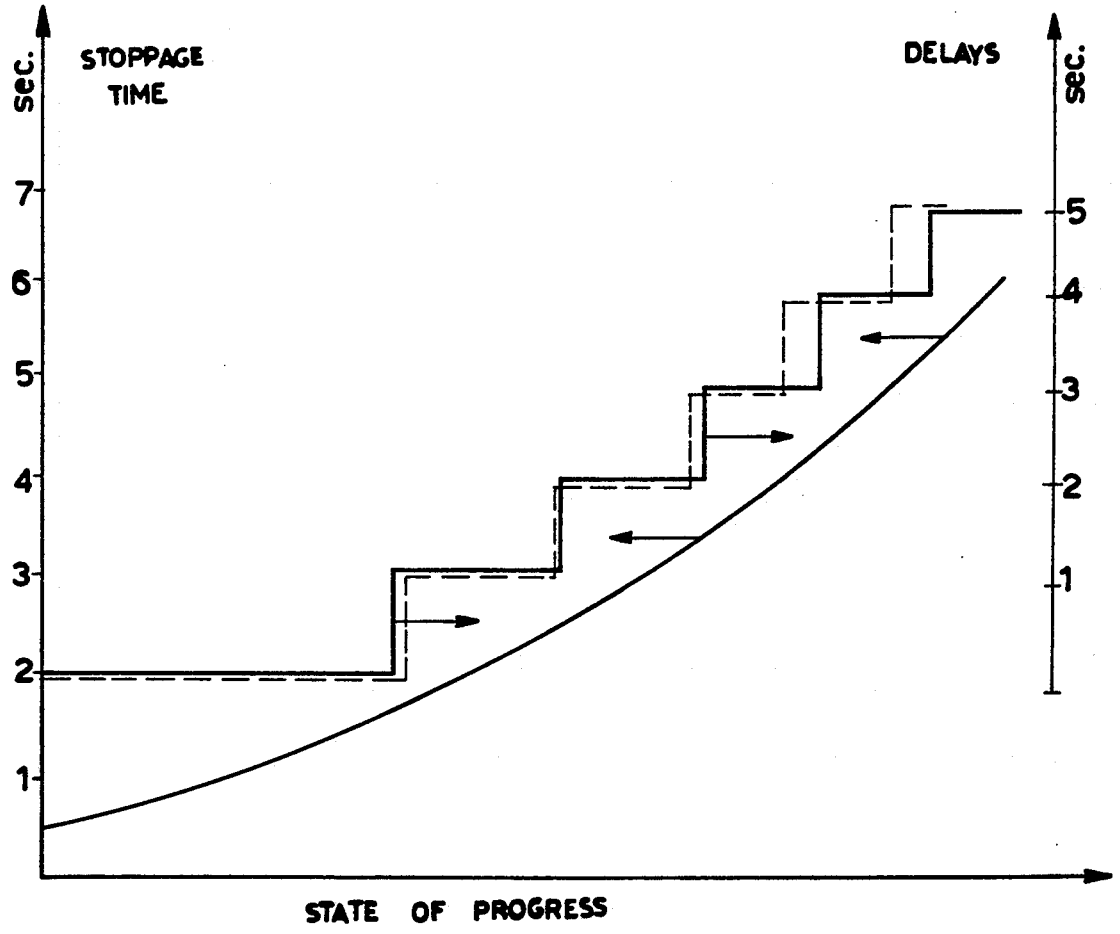
FIG. 3 is a graphical representation of the length of the delay values relative to the bobbin stoppage times.

Depending on the criterion used for assigning the times available for braking or the delays to be introduced into the commencement of the second part of the intervention cycle, a series of pairs of values is obtained to be fed into the memory of the main computer provided on the machine, or of the microprocessors provided in each winding station The patterns of the stepped lines corresponding to the two sets of pairs of values are given in FIG. 3.

This criterion for assigning delays enables the time assigned for braking to be adapted to any pattern of the curve of FIG. 2, and therefore does not require stoppage time calculations and/or experimental determinations to be made for sample bobbins in order to determine the series of limiting state of progress values beyond which the delay $\Delta t_n$ must be incremented, and which would need to be memorised in the memory.

It is apparent that the more numerous and close together the terms of the increasing series of times and/or delays to be assigned for bobbin braking, the closer the stepped line corresponds to the curve of FIG. 2, from which it deviates essentially by the applied increase, which itself depends on the required safety margin.

Figure 4:
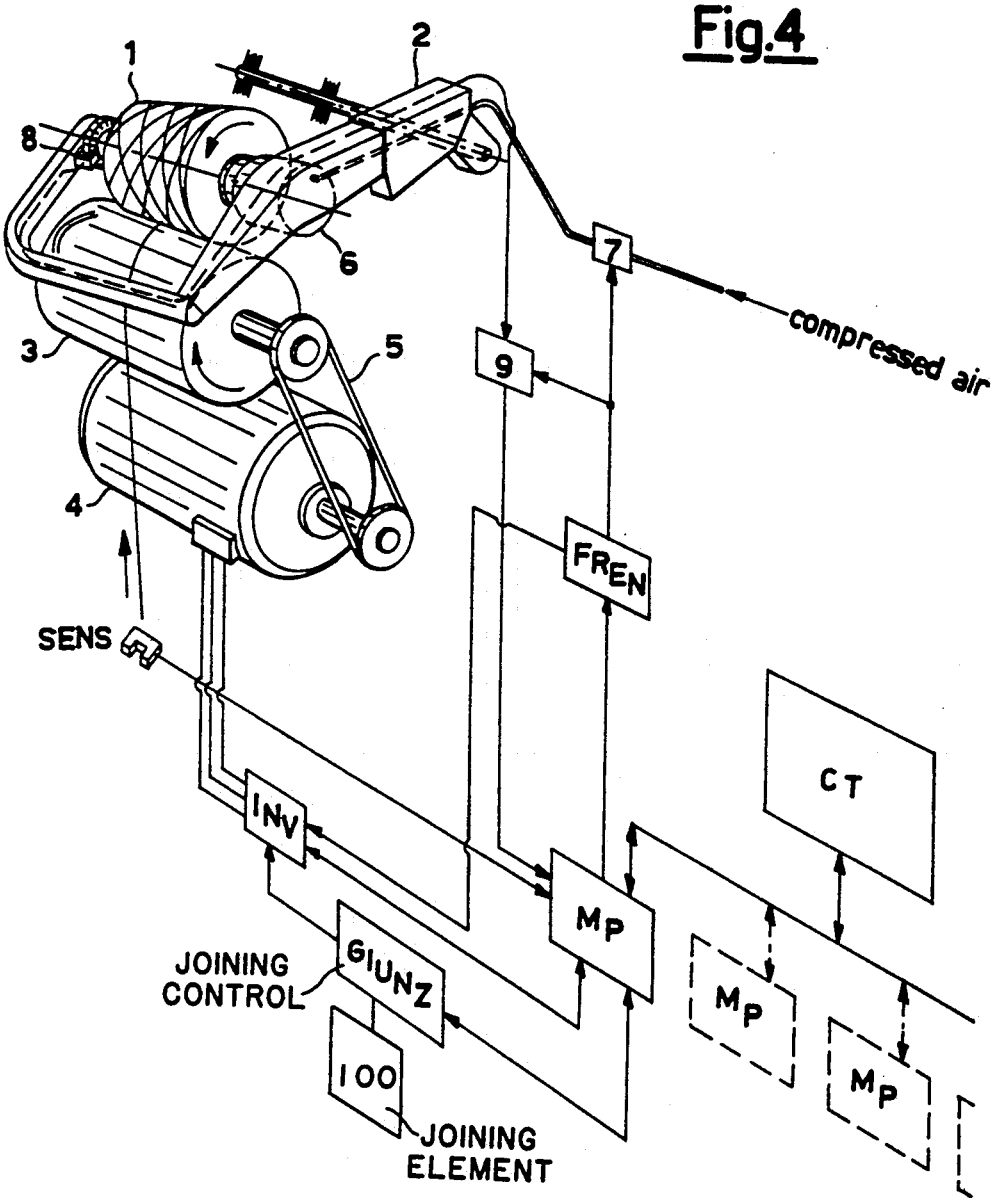
FIG. 4 is an orthogonal representation of the arrangement of the bobbin carrier arm and the drive roller with microprocessors and a computer.

The characteristics and advantages of the present invention will be more apparent from the description given hereinafter of a typical embodiment thereof with reference to FIGS. 4 and 5. The bobbin 1 under formation, the tube of which is engaged on the fixing centres of the bobbin carrier arm 2, rests against the roller 3 and rotates at a constant speed, driven by the motor 4 by way of a toothed belt drive 5. The bobbin 1 is therefore rotated by the roller 3 and winds the yarn about itself, its diameter gradually increasing.

The bobbin carrier arm 2 carries in its fixing centres a mechanical brake 6 operated pneumatically by compressed air through the solenoid valve 7.

On the fixing centres of the bobbin carrier arm 2 there is provided a bobbin-at-rest sensor 8 which, when the bobbin 1 has stopped, feeds a pulse to a time measurement instrument 9 which is connected to the control for the solenoid valve 7 and measures for each intervention cycle the effective time interval between the transmission of the braking command fed to the solenoid valve 7 and the moment when the bobbin 1 comes to rest.

Each winding station —commonly known as the winding head or simply head —is provided with a microprocessor MP which generates the commands and controls the operations of the winding head. Said microprocessor MP is connected to the following: to the yarn sensor SENS which—when it detects a break in yarn continuity-tells MP that the intervention cycle has to commence; to the brake control FREN which operates the brake 6 by the solenoid valve 7 and operates the other members which implement the braking cycle; to the instrument 9 from which it receives information relative to the effective braking time and therefore obtains the previously described "empirical" state of progress; to the inverter INV to which it feeds stop and start signals for the motor 4 and thus for the roller 3; and to the joining control GIUNZ which sequentially activates the various members by means of joining element 100 which implement the joining cycle. The delays with which GIUNZ is activated are determined by a timer device incorporated in the microprocessor MP but not indicated on the figure.

The microprocessor MP is also connected to other winding head functions and also to the machine processor or head computer CT which controls the operation of the entire winding machine by information and controls interchange with the various microprocessors MP.

The procedure takes place in accordance with the following logic scheme.

The microprocessor MP contains in its memory the set of pairs of values of limiting effective stoppage times and delays to be assigned; this set can be modified by command from the CT.

At each commencement of formation of a new bobbin, the microprocessor MP zeroes the last recorded effective stoppage time relative to the completed bobbin.

At an $n^{th}$ break in the continuity of the yarn the bobbin/roller assembly is braked, each separately by its own brake, and the effective bobbin braking time $T_n$ is measured.

The command for commencing the second part of the $n^{th}$ intervention cycle, governed by the GIUNZ unit, is given by the microprocessor MP with a delay $\Delta t$ determined on the basis of the effective stoppage time $T_{n-1}$ and measured with a timer device. The effective bobbin stoppage time of the $n^{th}$ intervention cycle is compared with the series of values $T_{lim1}$, $T_{lim2}$, $T_{lim3}$ . . . to find the minimum $T_{lim}$ value which is still greater than the measured $T_n$, and the corresponding $\Delta t$ used for the next $(n+1)^{th}$ intervention cycle. This new $\Delta t$ delay value is fed into the timer device and is valid for the next $(n+1)^{th}$ cycle.

Figure 5:
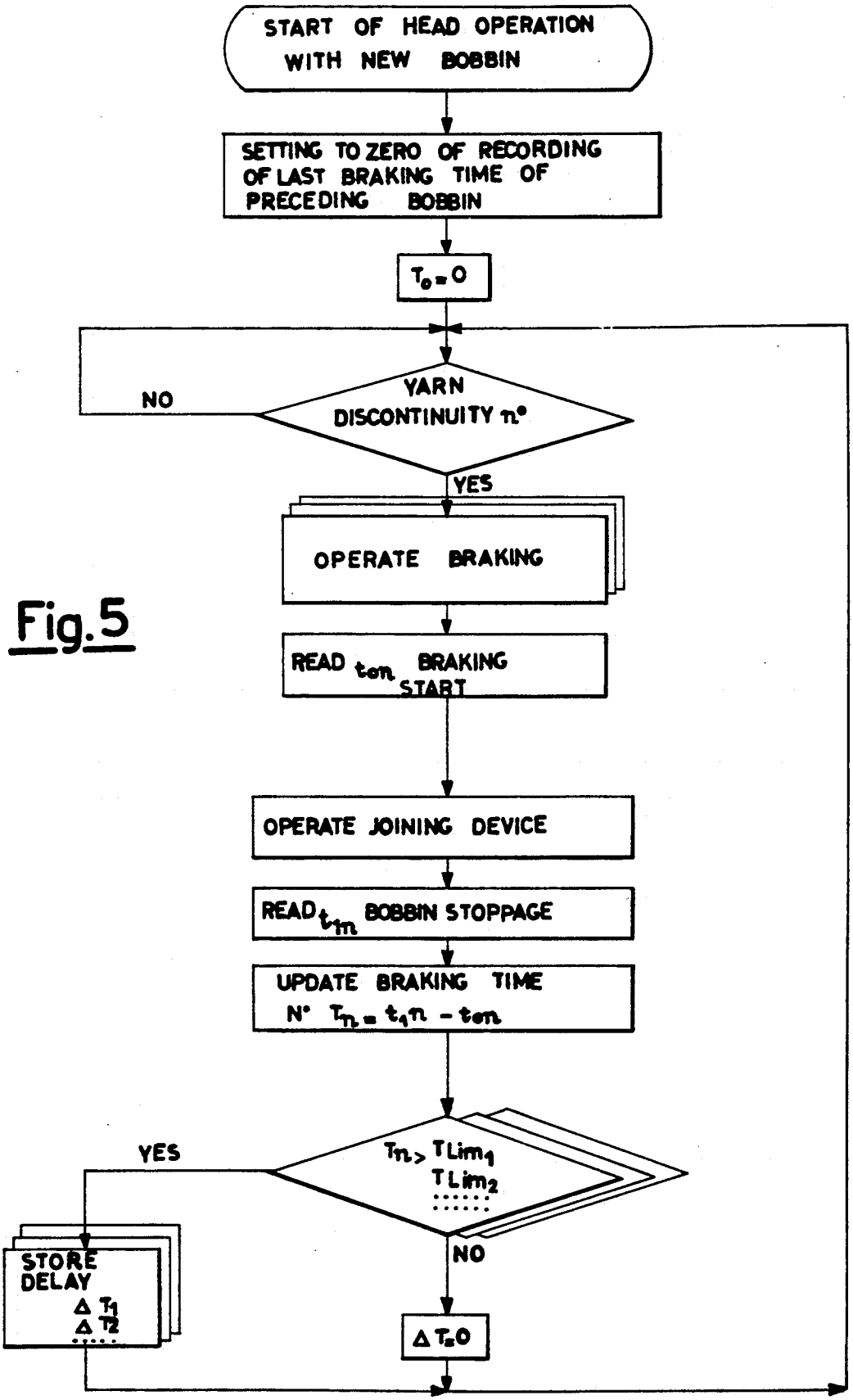
FIG. 5 is a diagram of the control logic of the present invention.

This logic scheme is shown in FIG. 5.

Figure 6:
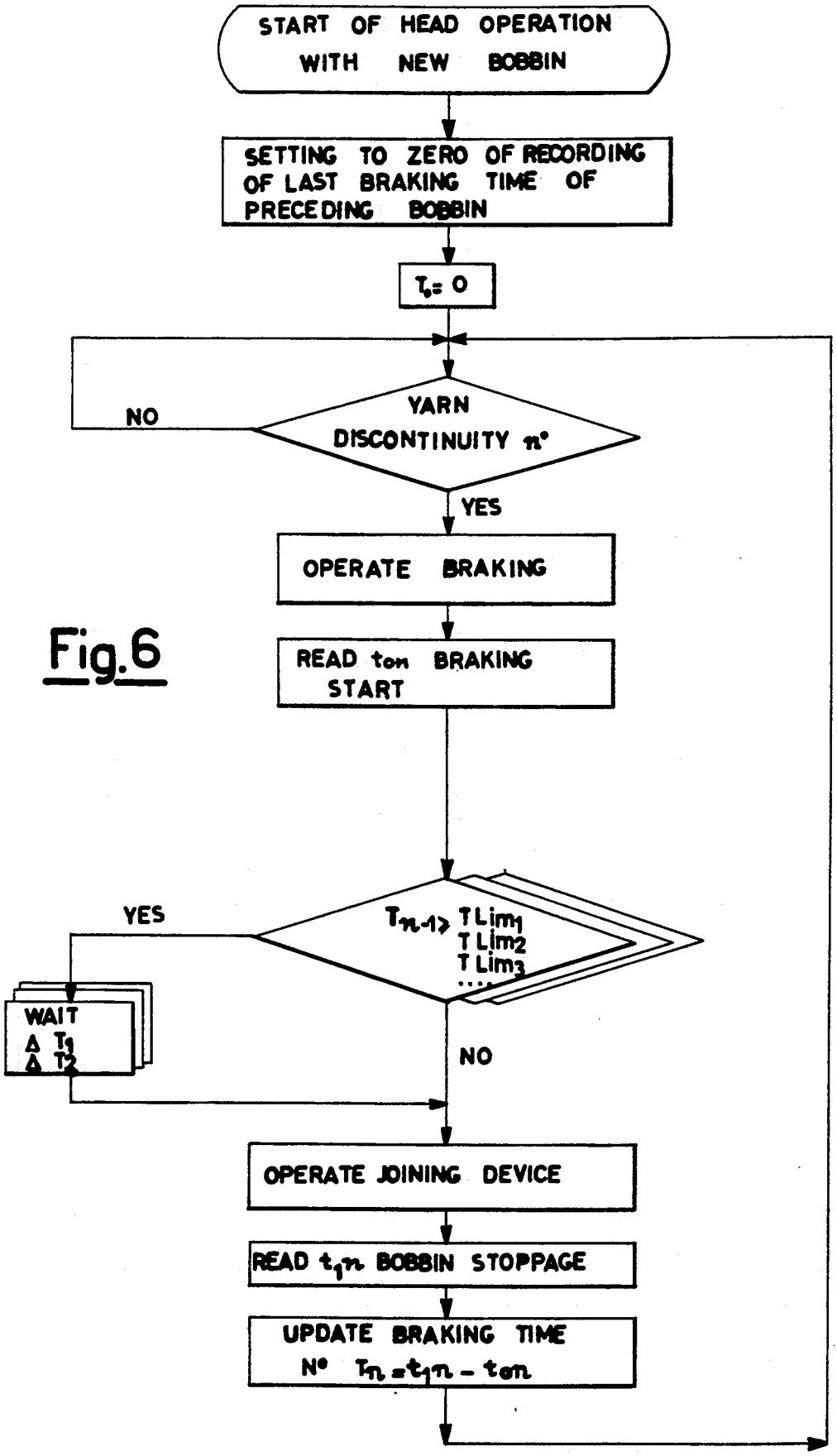
FIG. 6 is a diagram of a modification of the control logic of the present invention.

A modification of this logic scheme is shown in FIG. 6, in which the determination of the delay $\Delta t$ to be used for the $n^{th}$ intervention cycle is made—again by comparing $T_{n-1}$ with the values of the set of $T_{lim}$ values—at the moment of the $n^{th}$ break in yarn continuity.

The advantages obtained by the present invention are apparent from the aforegoing description, namely:

the possibility of varying the time available for bobbin braking means that winding can proceed at higher speeds and/or larger diameter bobbins can be wound without extending said braking time beyond that strictly necessary;

any efficiency loss in the bobbin brakes with the passing of time can be compensated by varying the series of Olim values and/or the series of times available for stoppage;

the winding speed and/or the diameter of the bobbins produced can be varied without modifying either the machine or the data stored in the machine processor memories;

the winding machine can be automatically adjusted for any variation in winding parameters or efficiency of the braking device;

the criterion for assigning the method safety margin can be varied by simply varying the $T_{lim}$ set contained in the memory.

We claim:

1. A method for winding yarn onto a rotating bobbin driven by a drive roller and supported by a carrier arm when the yarn feed is broken and the bobbin is brought to rest each time the yarn breaks, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating; and wherein said second portion comprises joining the broken yarn; and (b) interposing a variable time delay between the commencement of said bobbin braking step of said first portion and the commencement of said joining step of said second portion of said intervention cycle by means of a timer device wherein said variable time delay is determined by the amount of yarn wound on the bobbin, wherein the amount of yarn wound on the bobbin is determined by measuring the amount of time required for said braked bobbin to come to rest in a preceding time the yarn breaks.

2. The method of claim 1 wherein said amount of time required for said braked bobbin to come to rest is determined by measuring the time elapsed between the moment said braking of the bobbin occurs and the moment when said braked bobbin comes to rest further comprising giving a signal the moment the bobbin comes to rest.

3. The method of claim 2 further comprising:

(a) comparing said time required for said braked bobbin to come to rest with a series of delay limiting values by a delay identifying means; and (b) sending said delay to said timer device by said delay identifying means.

4. The method of claim 3 wherein said series of delay limiting values sent to said timer device further comprises a discrete series of increasing time limiting values.

5. The method of claim 4 wherein zero is the first value of said discrete series of increasing time limiting values.

6. A device for winding yarn onto a rotating bobbin driven by a drive roller and supported by a carrier arm when yarn feed in a winding station is broken and the bobbin is brought to rest each time the yarn breaks, comprising:

(a) a bobbin raising means for raising the rotating bobbin from the drive roller when the yarn feed is broken;

(b) a bobbin braking means for braking the rotating bobbin until the bobbin stops rotating;

(c) a drive braking means for braking the drive roller independently from said bobbin braking means;

(d) a control means linking said bobbin raising means, said bobbin braking means, and said drive roller means all together;

(e) a joining means to join the broken yarn;

(f) a measuring means for measuring the time required for braking the rotating bobbin during a preceding time the yarn breaks and for calculating an increase in braking time; and (g) a variable time delay means for interposing a variable time delay between the commencement of the operation of said bobbin braking means and the commencement of the operation of said joining means.

7. The device of claim 6 for bringing said braked bobbin to rest each time the yarn breaks, wherein said measuring means further comprises:

(a) a sensor means for determining when said braked bobbin comes to rest and for sending a first signal when said braked bobbin comes to rest;

(b) a solenoid valve control means for controlling the operation of said bobbin braking means and for sending a second signal when said bobbin braking means begins braking;

(c) an instrument connected to said sensor means and said solenoid valve control means for receiving said first signal and said second signal and for measuring the time elapsed between receiving said first signal and said second signal; and (d) a microprocessor connected to said instrument for comparing said increase in braking time with a series of prefixed delay times for determining said variable time delay wherein said prefixed delay times are set prior to initiating the operation of said joining means and said variable time delay is the lowest value of said series of prefixed delay times greater than the time required for braking the bobbin in a preceding time the yarn breaks.

8. The device of claim 7 including a plurality of winding stations wherein each of said winding stations has a microprocessor for comparing said series of delay limiting values with the time required for said braked bobbin to come to rest in the preceding time the yarn breaks and for interposing the next time delay by setting said time delay corresponding to a value equal to the lowest value of said series of delay limiting values and greater than the time required for said braked bobbin to come to rest in the preceding time the yarn breaks.

* * * * *